United States Patent [19]

Tay et al.

[11] Patent Number: 4,549,929

[45] Date of Patent: Oct. 29, 1985

[54] TIN COMPOUNDS FOR BRIGHTNESS IMPROVEMENT OF JACK PINE ULTRA

[75] Inventors: Ching-Hua Tay, Mississauga; Raymond S. Fairchild, Burlington, both of Canada

[73] Assignee: Abitibi-Price Inc., Toronto, Canada

[21] Appl. No.: 638,073

[22] Filed: Aug. 6, 1984

[30] Foreign Application Priority Data

Sep. 6, 1983 [GB] United Kingdom ..... 8323808
Dec. 1, 1983 [GB] United Kingdom ..... 8332143

[51] Int. Cl.[4] ..... D21C 9/00

[52] U.S. Cl. ..... 162/78; 162/79; 162/83

[58] Field of Search ..... 162/78, 79, 160, 83

[56] References Cited

U.S. PATENT DOCUMENTS 3,929,558 12/1975 Shaw ..... 162/79
4,247,362 1/1981 Williams ..... 162/28
4,410,397 10/1983 Kempf ..... 162/79

*Primary Examiner*—William F. Smith
*Attorney, Agent, or Firm*—Arne I. Fors; Robert F. Delbridge

[57] ABSTRACT

Wood pulps, particularly sulphonate pulps, such as jack pine ultra-high-yield pulps produced by sulphonation, are readily discolored by metal ions commonly found in paper mills. Additions of 0.001 to 2% on pulp dry basis of tin ions, especially derived from stannous compounds, to wood pulps effectively brighten the pulps at ambient temperature.

Metal ions such as ferrous, ferric, cupric, aluminum, nickel and manganese are common discoloring ions and pulps containing these ions can be brightened by the addition of tin ions particularly derived from stannous chloride, stannous sulphate, stannous tartrate, stannous oxolate, stannic chloride and stannic sulphate, the tin ions as $Sn^{+2}$ being added in an amount to provide a ratio of stannous ions to discoloring metal ions up to about 2:1, preferably about 1.5:1.

13 Claims, 10 Drawing Figures

EFFECT OF METAL IONS ON REFLECTANCE CURVES OF UHY PULP

TIN COMPOUNDS FOR BRIGHTENING IRON-DISCOLOURED PULP

EFFECT OF pH ON $Sn^{+2}$ TREATMENT FOR BRIGHTENING CUPRIC-DISCOLORED PULPS

EFFECT OF pH ON $Sn^{+2}$ TREATMENT FOR BRIGHTENING FERROUS-DISCOLORED PULP

EFFECT OF ALUM ON BRIGHTNESS CHANGES OF UHY PULPS

TIN COMPOUNDS FOR BRIGHTNESS IMPROVEMENT OF JACK PINE ULTRA

BACKGROUND OF THE INVENTION

This invention relates to the brightening of wood pulps and, more particularly, relates to the brightening of sulphonate pulps.

The presence of various metallic substances in wood pulp is very common. The metallic substances can be from those originally present in the wood or contamination from process equipment, process water and chemicals artificially introduced. Wood pulp can be considered as a natural chelating agent, complexing metal ions mainly through lignin and other aromatic compounds. Numerous metal ions are known to form colored complexes, thereby lowering the pulp brightness and producing undesirable discolorations. Some metals present in pulp catalyse the decomposition of bleaching agents such as hydrosulphite and hydrogen peroxide. The presence of heavy metal ions causes brightness instability of paper.

In order to reduce the problems associated with metal contamination, application of chelating agents has been a common practice. Generally, the complexes formed are water soluble and should be removed from the system.

Japanese Kokai No. 12,822/80 assigned to G. Okuro described a treatment of kraft pulp with a metal salt including tin to avoid the emission of hydrogen sulphides, thereby inhibiting corrosion of silver, copper or lead wrapped in the paper. Stannous chloride, used together with disodium or sodium phosphate, is described in U.S.S.R. Pat. No. 787,518 to stabilize hydrogen peroxide in a pulping process. A combination of tin or other water soluble metallic compounds, lignosulphonate and cationic polymeric flocculant is described to be effective for biological oxygen demand (BOD) and chemical oxygen demand (COD) reduction of pulping effluent in Japanese Kokai No. 55701/77. Sodium stannate and other reducing agents in soda liquor have been used to cook black spruce chips to obtain a brighter pulp.

In common with other lignin-rich wood pulps, jack pine and spruce balsam ultra-high-yield (UHY) pulps prepared by digesting chips with sulphite under various conditions, followed by disc refining, are readily discolored by many metal ions commonly found in pulp and paper mills.

STATEMENT OF THE INVENTION

It has been surprisingly found that, at a modest dosage rate of 0.001–2% as metal on pulp dry weight basis, tin ions, especially derived from stannous compounds, have been found to have the ability to brighten the pulp discolored with metal ions. The brightness improvement can easily be obtained at room temperature in less than 10 minutes at any pulp consistency and is remarkably significant for ferric-contaminated pulp. Stannous compounds are compatible with bisulphite, hydrosulphite and hydrogen peroxide and can be applied in the mechanical refining stage for brightness improvement.

Jack pine UHY pulps, especially those prepared from pH 4–7 cooks with the addition of alum for pitch control, often attain a distinct yellow color resulting in severe brightness losses. Pretreatment of the pulp with the ions prior to the addition of alum significantly reduced brightness losses at pH 6, obviated brightness losses at pH 7–8, and enhanced brightness at pH 10 with increased alum dosage rate.

Spruce high yield (HY) sulfite pulps are prone to forming a reddish color when complexed with cupric ions, substantially reducing brightness. The discolored pulp, when treated with modest levels of tin ions, exhibits improved color and brightness.

More particularly, the method of the present invention for brightening a wood pulp containing discoloring metal ions comprises adding to said pulp at least 0.001% tin ions, on a pulp dry weight basis, derived from a stannous compound or stannic compound. The wood pulp normally is a sulphonated pulp and the discoloring metal ions are present from at least one of the group consisting of ferrous, ferric, cupric, aluminum, nickel and manganese ions.

The tin ions are derived from the group consisting of stannous chloride, stannous sulphate, stannous tartrate, stannous oxalate, stannic chloride and stannic sulphate and are added in an amount in the range of 0.001 to 2.0% on a pulp dry weight basis, preferably in an amount of 0.05%. The tin ions preferably are added as $Sn^{+2}$ in an amount to provide a ratio of stannous ions to discoloring metal ions of up to about 2:1, preferably about 1.5:1.

Jack pine and spruce sulphonated pulps can be treated with the addition of stannous ions added in an amount of about 0.01 to 2.0% on a pulp dry weight basis. Jack pine pulp containing at least one of ferric, ferrous or cupric discoloring ions, can be treated with stannous ions derived from stannous chloride added in an amount to provide a ratio of stannous ions to discoloring ions of up to about 2:1. Wood pulp sized with alum, i.e. aluminum sulphate, can be treated by adding, on a pulp dry weight basis, at least 0.01% stannous ions in a stannous compound prior to the addition of the alum.

BRIEF DESCRIPTION OF THE DRAWINGS

Typical applications of the process of the invention will be described with reference to the following Examples taken in conjunction with the drawings, in which.

DESCRIPTION OF PREFERRED EMBODIMENTS OF THE INVENTION

Figure 1:
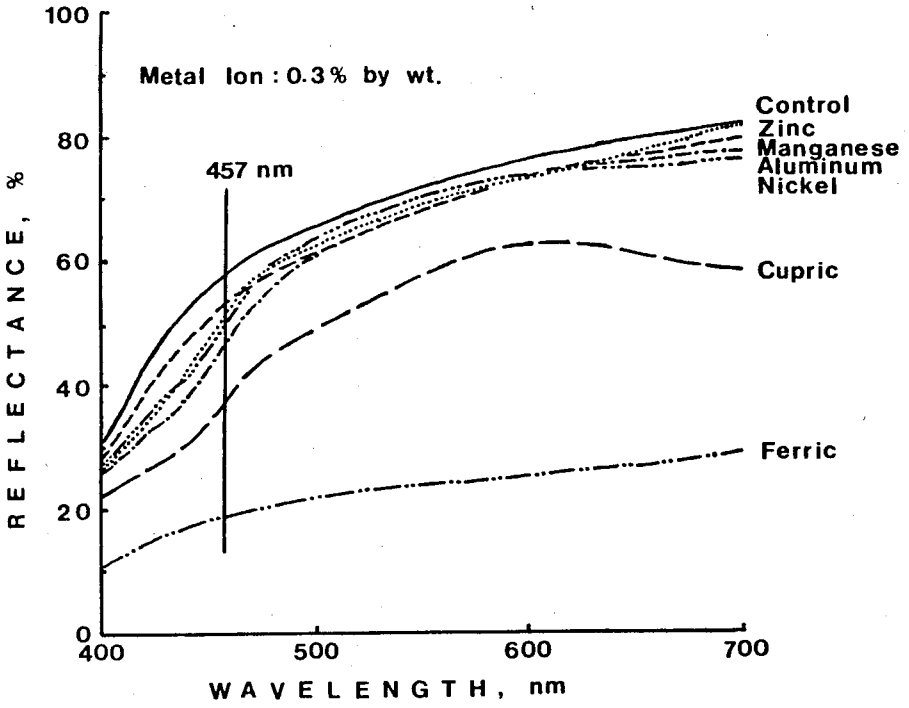
FIG. 1 illustrates spectral curves for a jack pine pulp after addition of metal ions.

It will be understood that although the following examples largely relate to the treatment of jack pine pulps, the process of the invention can be used for the treatment of other pulps.

Jack pine (68 years old) was cut from a pure natural stand preserved for research purposes near Thunder Bay, Ontario. The logs were chipped and then shredded by passing once through a 24 inch double disc Bauer TM refiner at 0.275 inch clearance. The pine chips were presteamed in a digester equipped with a liquor circulator and heat exchanger for 10 minutes and cooked with sulphite at a liquor to wood ratio of about 6:1 under various cooking liquor pH, temperature and time conditions to give 85–92% pulp yields. After pressing through a plug screw feeder, the cooked chips were passed through the refiner at desired loadings to give UHY pulp with various Canadian standard freeness (CSF) levels for further characterization.

Reagent grade chemicals were used throughout the tests. Unless otherwise specified, the chemical treatment was carried out as follows: 3 gms (o.d.) of pulp were dispersed in 250 ml of distilled water and a desired amount of freshly prepared metal salt solution was added. No pH adjustment was made. After stirring at room temperature for 5 minutes, each pulp sample was deposited onto a Reeve Angel TM No. 230 filter paper under vacuum and the sheet pad was pressed between blotters and air-dried. All the reflectance curves were obtained on a Varian DMS-90 TM UV/Visible spectrophotometer with a diffuse reflectance accessory. For some samples, standard brightness pads were prepared and TAPPI brightness values were determined using an Elrepho TM instrument. The readings from both instruments were substantially the same for a given sheet sample.

Lignosulphonate was prepared from sulphite spent liquor taken from a spruce low yield sulphite pulping process. The spent liquor was treated with 0.5% diethylenetriaminepentaacetic acid (DTPA) and concentrated in an evaporator. The concentrate was added dropwise into 50 times volume ethanol with stirring and the precipitate was collected by centrifugation. The procedure was repeated twice and finally the precipitated lignosulphonate was washed with ethanol several times and vacuum-dried. The isolated lignosulphonate was very light in color and easily redissolved in water.

Sodium hydrosulphite bleaching was carried out with 1.5% Virwite 10 and 2% pulp consistency at 65° C. for 1.5 hrs, while hydrogen peroxide bleaching was performed using 2.5% $H_2O_2$, 2.5% total alkalinity and 12% pulp consistency at 50° C. for 2 hours, after the pulp was treated with 0.5% DTPA —a chelating agent. Metal content in the pulp was analyzed by a Hitachi TM 180-60 polarized Zeeman TM atomic absorption spectrophotometer.

EXAMPLE I

Metal Contamination of Jack Pine UHY Pulp

Jack pine shredded chips were sulphonated with 5% $Na_2SO_3$ (pH 9.6) at a liquor to wood ratio of 6:1 at 90° C. for 0.5 hour, followed by a vapour phase cook at 130° C. for an additional one hour. The cooked chips were refined to 121–126 CSF using a 12 inch Sprout-Waldron TM refiner or a 24 inch Bauer refiner. The pulps obtained were analysed for metal contents by atomic absorption, and the results are given in Table I. Obviously, both pulps were contaminated with metals. The pulp obtained from the Bauer (Sample 2) refiner contained considerably higher amounts of iron and copper than from the Sprout-Waldron refiner (Sample 2), and this contributed to the brightness difference as shown.

TABLE I

Metal Contents of Jack Pine UHY Pulps

| Sample No. | CSF ml | Pulp Brightness % (Elrepho) | Metal Content in Pulp, ppm Cu | Mn | Fe | Al |
|---|---|---|---|---|---|---|
| 1 | 126 | 56.6 | 9 | 59 | 53 | 13 |
| 2 | 121 | 51.2 | 54 | 34 | 109 | 20 |

Sulphonation: 5% $Na_2SO_3$, 6/1 = L/w ratio, 90° C., 0.5 hr + vapour phase cook, 130° C., 1 hr Table II illustrates progressive reduction in pulp brightness as the amounts of copper and iron present in the pulp increased with the increase in the number of passes through the Bauer refiner. It was confirmed that the copper contamination was mainly from the water used, whereas iron was chiefly from the refining plates. A similar problem was encountered in handsheet making using the standard British tester because of copper pipe and brass equipment. About 5–10 points brightness losses were noticed compared with that from a brightness pad which was prepared with distilled water.

TABLE II

Increased Metal Contamination During Refining

| Bauer Refining | CSF, ml | Metal Content in Pulp, ppm Cu | Fe | Pulp Brightness, % (Elrepho, British sheet) |
|---|---|---|---|---|
| A Pass | 676 | 10.3 | 42.1 | 46.4 |
| B Pass | 379 | 17.0 | 43.1 | 45.2 |
| C Pass | 227 | 21.2 | 54.5 | 44.0 |
| D Pass | 105 | 33.4 | 55.0 | 40.8 |

Sulphonation: 5% $Na_2SO_3$, 6/1 = L/w ratio, 150° C., 1 hr/1 hr

EXAMPLE II

Detrimental Effect of Metals on Brightness and Colour of Jack Pine UHY Pulp

The degree of pulp discoloration brought about by metal ions was greatly influenced by the sulphonation conditions, especially cooking liquor pH. Six most common metal salts were examined for their effect on pulp brightness and color changes, and the results are given in Table III and FIG. 1. In all cases, the same amount of 0.3% tin in the form of metal ion on pulp dry weight basis was used to treat the pulp. It is evident that ferric and cupric ions were extremely detrimental to the pulp brightness. The brightness losses from the other discoloring metal ions were noticeably less but varied widely depending upon the pulp examined.

TABLE III

Detrimental Effect of Metal Ions on Brightness of Jack Pine UHY Pulps at 0.3% Addition Based on Metal Ion

| Sample No. | Initial Brightness %(1) | Brightness Loss, points* $Zn^{+2}$ | $Mn^{+2}$ | $Ni^{+2}$ | $Cu^{+2}$ | $Al^{+3}$ | $Fe^{+3}$ |
|---|---|---|---|---|---|---|---|
| 1 | 56.4 | −4.8 | −6.2 | −6.3 | −16.6 | −9.7 | −37.0 |
| 2 | 47.3 | +0.1 | −1.8 | −4.1 | −15.8 | −1.6 | −32.9 |
| 3 | 50.7 | −1.5 | −3.7 | −6.1 | −18.7 | −4.0 | −35.9 |
| 4 | 50.0 | −9.4 | −9.5 | −11.0 | −18.0 | −9.6 | −35.4 |

TABLE III-continued

Detrimental Effect of Metal Ions on Brightness of Jack Pine UHY Pulps at 0.3% Addition Based on Metal Ion

| Sample No. | Initial Brightness %(1) | Brightness Loss, points* | | | | | |
|---|---|---|---|---|---|---|---|
| | | $Zn^{+2}$ | $Mn^{+2}$ | $Ni^{+2}$ | $Cu^{+2}$ | $Al^{+3}$ | $Fe^{+3}$ |
| 5 | 52.4 | −1.4 | −2.7 | −3.0 | −16.7 | −8.2 | −36.8 |

(1) Based on brightness pad and Varian DMS-90 Spectrophotometer at 457 nm wavelength
1: Alkaline extraction (pH 12.5) at 60° C. for 1 hr → Acid sulphonation (pH 4.4), 1 hr to 1/1 hr at 150° C.
2: Alkaline sulphonation (pH 9.6), 1 hr to/1 hr at 150° C.
3: Alakline sulphonation (pH 11), 1 hr to/1 hr at 150° C.
4: Alkaline extraction (pH 12.5) at 60° C. for 1 hr → Alkaline sulphonation (pH 9.6), 1 hr to/1 hr at 150° C.
5: Alkaline sulphonation (pH 12), 1 hr to/1 hr at 150° C. → Acid sulphonation (pH 4), 1 hr to/1 hr at 150° C.

As can be seen in FIG. 1, cupric, aluminum, zinc and nickel ions tended to cause yellow pulp coloration. The formation of yellow color was particularly pronounced for pulp from single stage acid sulphonation (pH 4–7) which was found to have very poor pitch removal efficiency and to alter the chemical structure of polyphenolic compounds, thereby causing yellow coloration.

EXAMPLE III

Stannous Ion for Brightness Improvement of Jack Pine UHY Pulp

Figure 2:
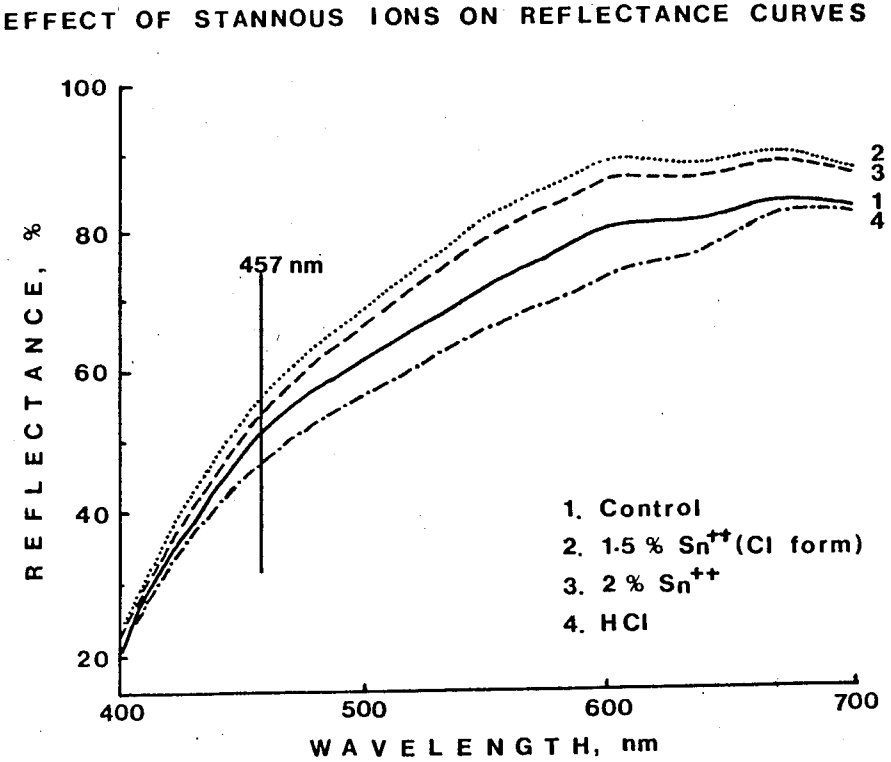
FIG. 2 illustrates spectral curves for a jack pine pulp before and after the addition of stannous ion in chloride form.

A typical jack pine UHY pulp from single stage alkaline sulphonation (89.3% pulp yield) was treated with 0–2% stannous ion in chloride form, and the brightness changes are shown in FIG. 2. Note that the pulp was taken after the first pass Bauer refining and was already discolored with metals to some extent. Addition of stannous chloride to the pulp improved remarkably the brightness throughout the whole visible spectrum. The increased reflectances were definitely not due to the presence of chloride ion, since the addition of hydrochloric acid adversely affected the pulp brightness. The data also suggested that there was an optimum dosage for brightness gain. The brightness improvements by stannous ion (chloride form) for five typical jack pine UHY pulps are given in Table IV, being from 2.7 to 7.8 points at 0.67 to 1.67% dosage rate as stannous ion based on pulp dry weight.

TABLE IV

Brightness Gains by Stannous Ion Addition (Cl form) on Jack Pine UHY Pulps

| Pulp No. | Bauer Refining | Tin Treatment as $Sn^{+2}$/pulp | TAPPI Brightness, 457 nm | | |
|---|---|---|---|---|---|
| | | | Initial | After $Sn^{+2}$ | Addition Change |
| 1 | F Pass | 1.67% | 55.2% | 60.0% | +4.8 points |
| 2 | D Pass | 0.67 | 51.6 | 56.6 | +5.0 |
| 3 | D Pass | 1.67 | 53.6 | 56.3 | +2.7 |
| 4 | D Pass | 1.67 | 46.9 | 54.7 | +7.8 |
| 5 | D Pass | 1.67 | 50.5 | 57.1 | +6.6 |

EXAMPLE IV

Improved Reflectances of Metal-Discolored Pulp by Stannous Ion Addition

Figure 3:
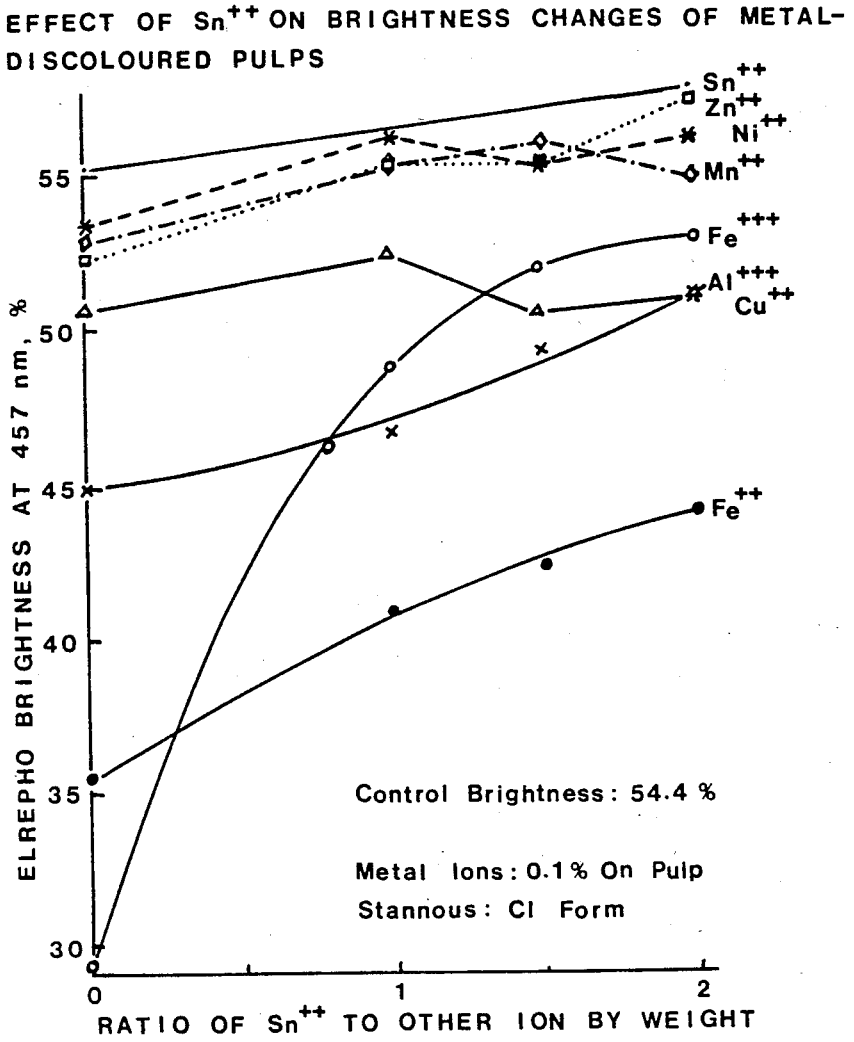
FIG. 3 shows the effect of stannous ion brightness change.

One jack pine UHY pulp from a single-stage sulphonation (pH 9.6) was artificially discolored by treating the pulp with 0.1% of various metal ions in pulp suspension. The discolored pulps were then treated with stannous chloride solution at various concentrations. The brightness pads were formed and Elrepho brightness readings at 457 nm wavelength were taken. The results as shown in FIG. 3 revealed that the addition of stannous chloride solution to the pulp suspensions was beneficial for all metal ions examined. At equal amounts of $Sn^{+2}$ addition, a complete brightness recovery for pulp discolored with $Mn^{+2}$, $Ni^{+2}$ and $Zn^{+2}$ was observed, but this was not the case for aluminum, cupric, ferrous and ferric treated pulps. The maximum brightness loss of 24.9 points was registered for ferric ion, compared respectively with 18.9 for ferrous and 9.4 points for cupric ion. Nevertheless the brightness restoration by stannous ion (chloride form) was suprisingly remarkable for the ferric-discolored pulp, showing a 97% brightness recovery at $Sn^{+2}$ to $Fe^{+3}$ ratio of 2:1 by weight.

Figure 4:
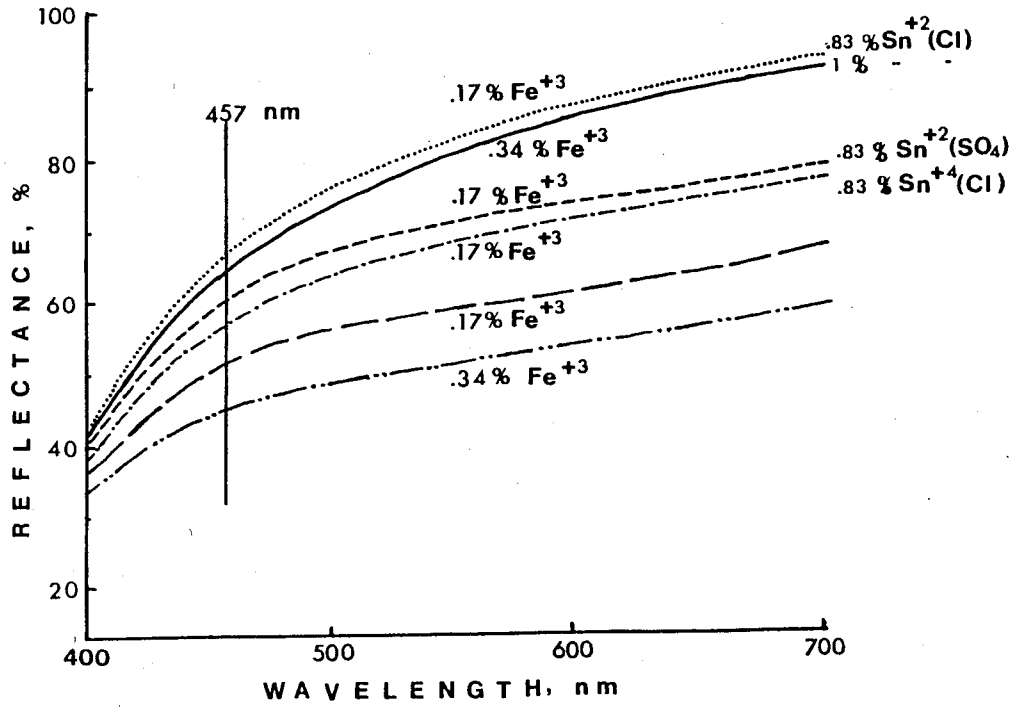
FIG. 4 illustrates the effect of tin compounds in brightening iron-discolored pulp.

The brightness improvement of ferric-discolored pulp by stannous ion addition was observed throughout the whole visible range as can be seen in FIG. 4. It is also clearly demonstrated that stannic ion was not as effective as stannous ion, and stannous chloride was more effective than stannous sulphate. Six different tin compounds were tested for their effectiveness and the results as given in Table V revealed that stannous oxalate outperformed others, improving 8.4 points in brightness over the control. Note that a tin solder was also found effective, giving a 4.8 point brightness improvement.

TABLE V

Brightness Gains by Various Tin Compounds At 0.8% As Metal Ion Based on Dry Pulp Weight

| | Brightness at 457 nm (%) | Drainage Time (seconds) | Brightness Improvement (Points) |
|---|---|---|---|
| Control | 48.2 | 57 | — |
| Tin (II) Chloride | 54.4 | 8 | 6.2 |
| Tin (II) Sulphate | 54.0 | — | 5.8 |
| Tin (II) Tartrate | 55.0 | 16 | 6.8 |
| Tin (II) Oxalate | 56.6 | 25 | 8.4 |
| Tin (IV) Chloride | 54.2 | — | 6.0 |
| 95% Tin Solder* | 53.0 | 55 | 4.8 |

Piece of solder added to pulp in beaker (see Table III for chip sulphonation conditions)

Figure 5:
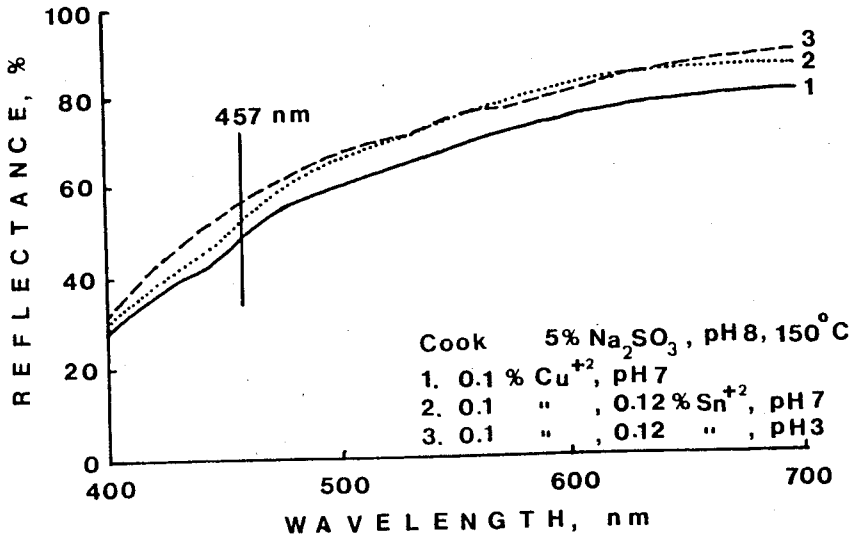
FIG. 5 illustrates the brightness gain of jack pine UHY pulp using stannous ion of pH's of 3 and 7 for pulp discolored by cupric ion.
Figure 6:
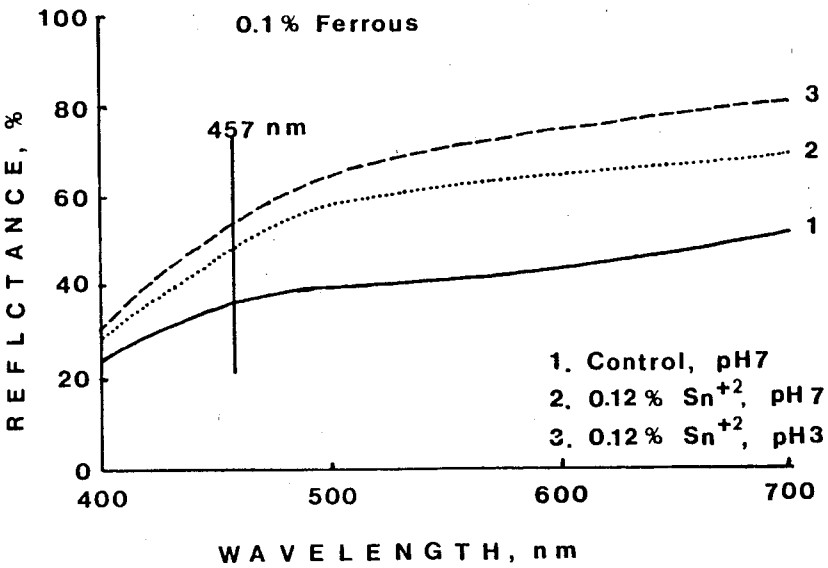
FIG. 6 illustrates the brightness gain of jack pine UHY pulp using stannous ion at pH's of 3 and 7 for pulp discolored by ferrous ion.

The effectiveness of stannous ion (chloride form) for brightness restoration of pulp discolored with cupric or ferrous ion was unsatisfactory as shown in FIG. 3. However, the performance of stannous ion became significantly better at pH 3 than at pH 7 as demonstrated in FIGS. 5 and 6. It should be pointed out that the brightness and color restoration of pulp contaminated with ferric ion can also be achieved by treating the dry sheet with stannous aqueous solution. DTPA chelating agent produced very little improvement under the same condition, suggesting that the brightening mechanism for tin compounds differs from that of conventional chelating agents.

EXAMPLE V

Stannous Treatment of Cooked Chips Prior to Refining

The brightness of the cooked jack pine chips varied widely depending upon the sulphonation conditions used. In general, acid and neutral sulphonation (pH 4–7) resulted in significantly brighter chips than did alkaline sulphonation (pH 8–12). Regardless of sulphonation conditions, pulps after Bauer refining had very low brightness. Further brightness losses were observed after standard British handsheet preparation. This was almost entirely due to metal contamination as described before. A similar phenomenon was also observed for a 88% yield bisulphite chemimechanical pulp (BCMP) from spruce/balsam fir. The chips were cooked at pH 6 (vapour phase) and then refined in a refiner.

Figure 7:
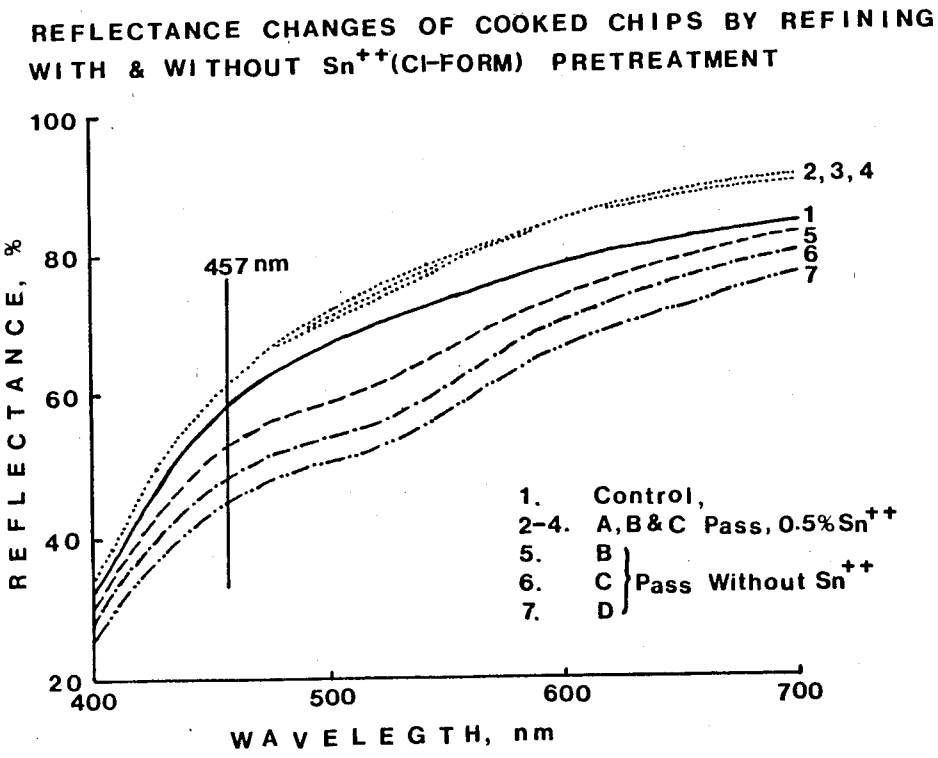
FIG. 7 shows brightness stability of jack pine chips pretreated with stannous ion.

Stannous chloride solution was sprayed on jack pine chips which had been cooked with sodium sulphite at pH 12.5 and then with bisulphite at pH 3.0. The treated chips were refined in the Bauer refiner as usual. The reflectance curves for pulps sampled at different refining stages are illustrated in FIG. 7. For comparison, reflectance curves for pulps from similar two-stage sulphonation but without tin treatment were also shown. Without stannous treatment, a steady loss in reflectance through tne whole visible region was clearly demonstrated. However, the application of stannous chloride not only improved the brightness but also maintained the gains after the third pass through the Bauer refiner. Combinations of tin and bisulphite gave even better results for chips especially sulphonated under alkaline condition (pH 8–12).

EXAMPLE VI

Brightening Mechanism by Tin Compounds

Tin, especially stannous, compounds are useful for brightness improvement of jack pine UHY pulps discolored with metal ions. Ionic replacement to form a less colored complex appeared to be an important mechanism for most metal ions with the exception of ferric ion. As pointed out before, stannous ion was exceptionally effective for restoring the brightness of pulp once darkened with ferric ion and this can take place even on a dry sheet, suggesting that the removal of iron is not essential for the brightness restoration. It was confirmed that ferric ion present in the sheet showed negative color reactions with potassium thiocyanate and potassium ferrocyanide after the sheet was treated with stannous chloride. This demonstrates that ferric ion could be reduced to less colored ferrous compound by stannous chloride which is known to be a reducing agent. However, this reductive reaction cannot explain the 97% brightness restoration because ferrous ion will inevitably discolor the pulp as shown in FIG. 3. Atomic absorption spectrophotometric analysis on a sheet treated with ferric and then stannous ion revealed that both metals were well retained in the sheet. A metal-metal complex which is nearly colorless may be formed.

Figure 8:
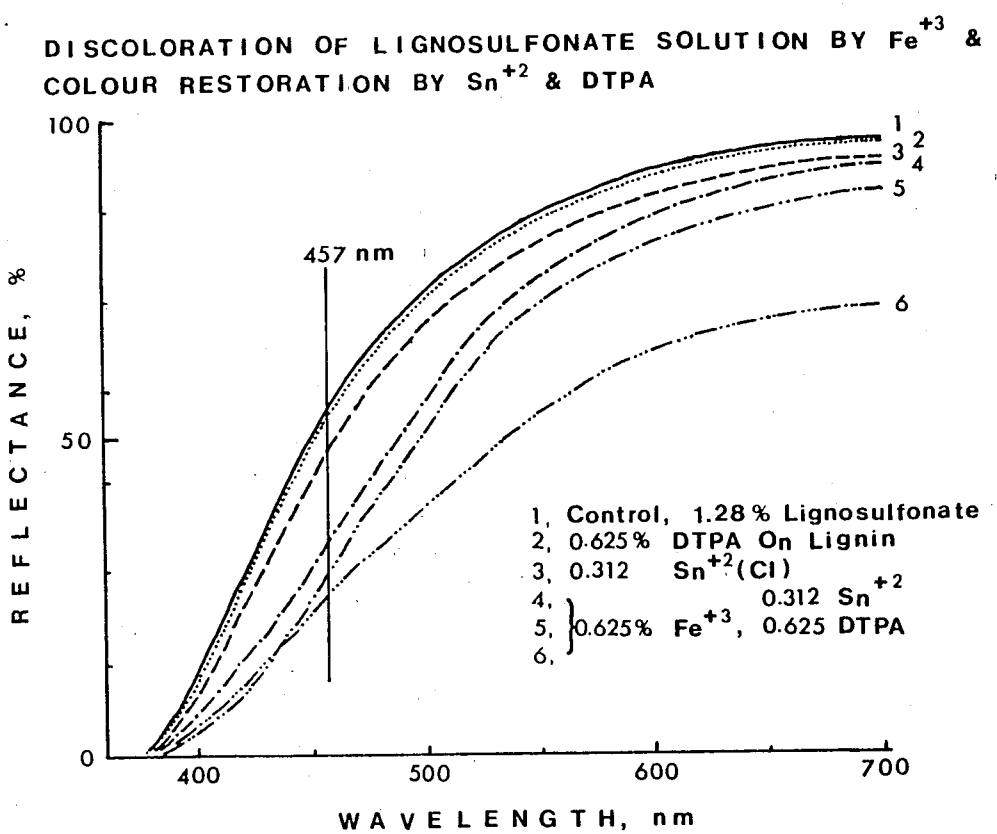
FIG. 8 shows discoloration of lignosulphonate solution by ferric ion with color restoration by stannous ion.

In order to better understand the mechanism, purified lignosulphonate solution was treated with ferric chloride and stannous chloride. The color changes as expressed by percent transmittance in the visible range are illustrated in FIG. 8. Addition of 0.6% ferric ion based on lignin darkened the lignin significantly, especially in the long wavelength region. Addition of stannous ion at 0.3% dosage rate brightened the solution previously discolored with ferric ion. A similar phenomenon was observed for jack pine UHY pulp, demonstrating that interaction between lignin and metal ions played an important role in contributing to the pulp discoloration. It was shown from this experiment that stannous ion was more effective than DTPA in brightening the lignin discolored with ferric ion. This was confirmed by an experiment carried out on pulp (see Table VIII).

EXAMPLE VII

Compatibility of Stannous Ion With Bleaching Agents

The interactions between stannous ion and heavy metals as described before benefit both hydrosulphite and hydrogen peroxide bleachings and this is clearly shown in Table VI. The additional gains of 2.1 and 2.7 points in brightness were obtained over that of the standard condition.

TABLE VI

Effect of Stannous Ions (Cl Form) on Bleaching of a Jack Pine Pulp

| (Chelating Agent) | Stannous Treatment | Bleaching Agent | 457 nm Brightness (%) | Brightness Gain (Points) |
|---|---|---|---|---|
| 0 | 0 | 0 | 50.5 | — |
| 0.5% DTPA | 0 | 2.5% $H_2O_2$ | 57.4 | |
| 0 | 0.8% $Sn^{+2}$ | 2.5% $H_2O_2$ | 59.5 | 2.1 |
| 0 | 0 | 1.5% $Na_2S_2O_4$ | 58.3 | |
| 0 | 0.8% $Sn^{+2}$ | 1.5% $Na_2S_2O_4$ | 61.0 | 2.7 |

As post treatment, six jack pine UHY pulps from chip sulphonation under various cooking liquor pH levels (pH 6–12) were treated with 0.2% stannous ion (chloride form) after the pulps were bleached with either hydrosulphite or hydrogen peroxide under standard procedure. The post treatment for pulps bleached with hydrosulphite showed almost no beneficial effect. On the contrary, all the six pulps bleached with hydrogen peroxide responded positively to the post treatment. It is highly likely that the brightness gains were associated with interaction between stannous ion and other metals which bonded strongly to the pulp and which cannot be removed by the chelating agent. The peroxide oxidation could also convert ferrous to ferric compound and, therefore, a favourable response to stannous ion was observed.

Stannous ion tends to react with jack pine UHY pulps produced from single stage acid sulphonation (pH 4–7) to give yellow coloration, if the pulps are relatively free of metal contamination. It is believed this results from the reaction between flavonol and stannous ion. This reaction is a well established colorimetric analysis for stannous compounds and many metal ions can interefere with this reaction. Indeed, it was observed that jack pine chips sulphonated at pH 6 gave a distinct yellow color after the chips were treated with stannous chloride, but the yellow color disappeared entirely after passing through the Bauer refiner and high pulp brightness was maintained for the next two passes.

EXAMPLE VIII

Stock Drainage with Tin Compounds

Stannous ion has the ability to improve stock drainage under static conditions as shown in Table VII and Table V. The filtrate was noticeably less turbid suggesting better fines retention. This suggests that stannous compounds may be used to replace papermakers' alum. The tin-treated sheet exhibited some sizing effect as observed by water drop tests. Neither physical stength properties nor brightness stability of the pulp was adversely affected by the treatment with stannous compounds.

TABLE VII

Effect of Stannous Ion (Cl Form) on Stock Drainage

| Pulp Treatment % Stannous Ion | Drainage Time Sec. |
|---|---|
| 0 | 70 |
| 0.03 | 60 |
| 0.27 | 38 |
| 0.34 | 32 |

TABLE VII-continued

| Effect of Stannous Ion (Cl Form) on Stock Drainage | |
|---|---|
| Pulp Treatment % Stannous Ion | Drainage Time Sec. |
| 0.50 | 18 |
| 0.82 | 8 |
| Distilled $H_2O$ only | 7.8 |

Drainage measurement under the condition for making a standard brightness pad

Filler-lumen loading was tested on one jack pine UHY pulp using $TiO_2$ with and without addition of stannous chloride. The original pulp had a brightness of 50.9 which was increased to 59.4 with $TiO_2$—lumen loaded pulp. When 0.2% stannous ion was introduced during $TiO_2$—lumen loading, the maximum brightness of 66.1 was obtained. The brightening effect by stannous ion (chloride form) and ethylenediaminetetraacetic acid (EDTA) was also observed for a BCMP from black spruce and balsam fir, as shown in Table VIII.

TABLE VIII

| Effect of Stannous Ion on Brightness Improvement of BCMP from Spruce and Balsam Fir | | |
|---|---|---|
| Refining | Chemical Treatment | Pulp Brightness, % (Elrepho, 457 nm) |
| C Pass | None | 51.7 |
| C Pass | 0.2% $Sn^{+2}$ (Cl) | 56.0 |
| E Pass | None | 49.8 |
| E Pass | 0.05% $Sn^{+2}$ (Cl) | 50.8 |
| E Pass | 0.1% $Sn^{+2}$ (Cl) | 52.9 |
| E Pass | 0.2% $Sn^{+2}$ (Cl) | 54.5 |
| E Pass | 0.25% $Sn^{+2}$ (Cl) | 54.7 |
| E Pass | 0.3% $Sn^{+2}$ (Cl) | 55.2 |
| E Pass | 0.5% EDTA | 50.0 |

Again, EDTA treatment was not as effective as the stannous chloride also demonstrated in FIG. 8. Undoubtedly, the tin treatment for brightness improvement is applicable to all lignin rich pulps discolored by metal contamination.

EXAMPLE IX

Stannous Pretreatment for Reducing Yellow Coloration Due to Alum

Figure 9:
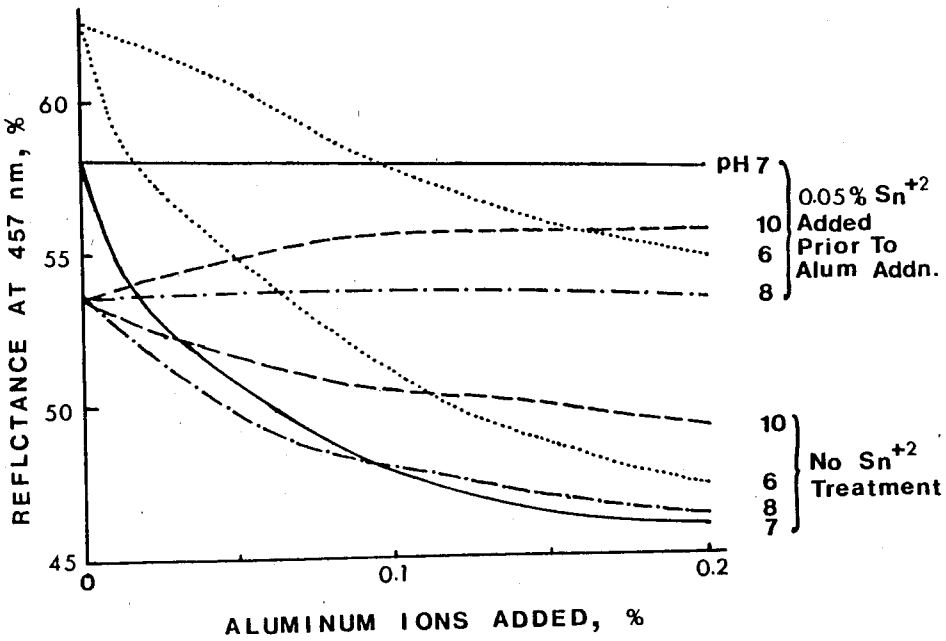
FIG. 9 illustrates the effect of alum on brightness changes of UHY pulps.

Jack pine UHY pulp, especially prepared from pH 4–7 cooks, can readily form a distinct yellow color, resulting in very severe brightness losses. Alkaline sulphonation and alkaline hydrogen peroxide bleaching have been found to be effective for reducing this yellow coloration. In order to examine the effect of stannous ion on the yellow coloration, four typical pulps were treated with 0.05% stannous ion followed by various concentrations of alum. The brightness changes were measured and compared with controls in FIG. 9.

For pulps without the stannous pretreatment, the brightness dropped with increasing alum application levels. Clearly this undesired chromophore generation can be greatly controlled by pretreating the pulp with stannous ions. Note that while the brightness loss was significantly reduced for the pH 6 cooked pulp, the tin compound completely blocked losses in brightness for pH 7 and pH 8 pulps. With the alkaline (pH 10) cooked pulp, there was actually a brightness improvement with increased alum dosage rate.

EXAMPLE X

Stannous Treatment for Overcoming Reddish Coloration of Spruce Sulphite Pulp

Figure 10:
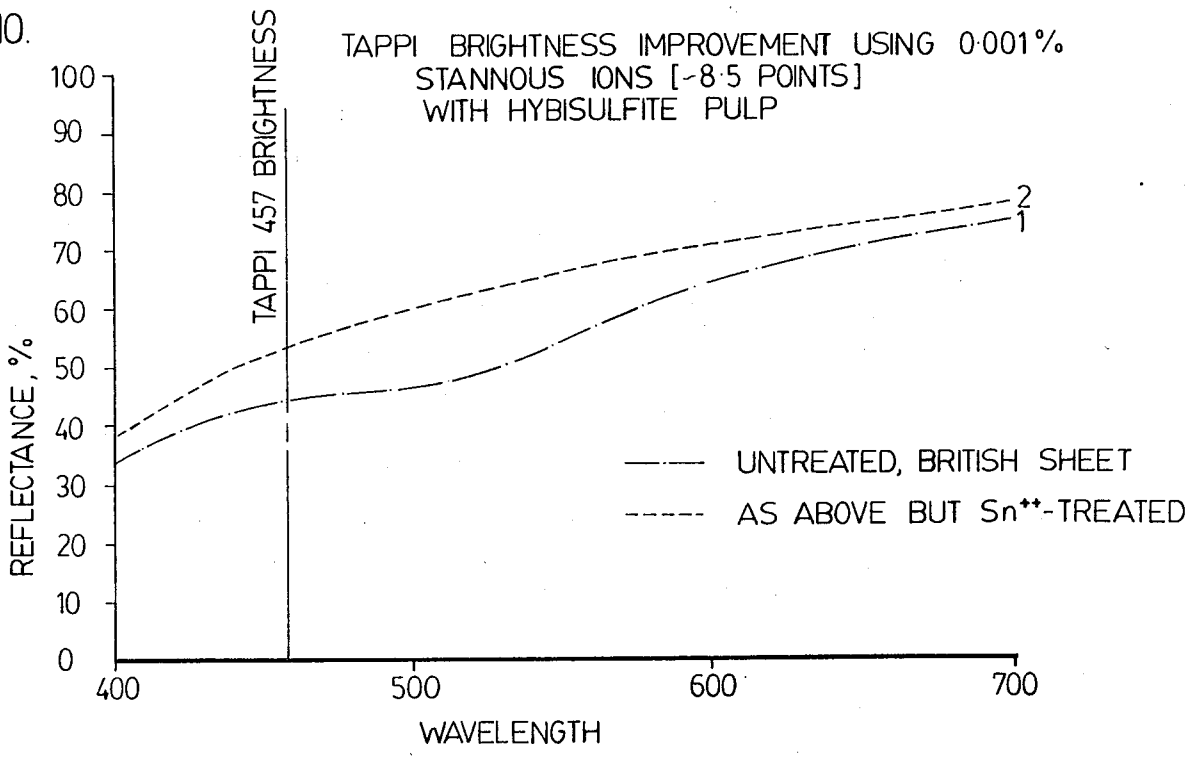
FIG. 10 shows brightness and color improvement in a spruce HY sulphite pulp complexed with cupric ions.

A HY bisulphite pulp from spruce readily forms reddish coloration during processing mainly due to contamination with specific metallic ions. As a result, the pulp brightness suffers. Treatment of this discolored pulp with stannous compounds resulted in disappearance of the reddish color and improvement of the reflectance throughout the whole visible range, as shown in FIG. 10. Stannous additions as low as 0.001% on dry pulp weight were effective in removing undesired reddish color as well as restoring brightness.

In summary, HY pulps are readily discolored with ferric, ferrous, cupric, aluminum, nickel, manganese and zinc ions through formation of colored complexes with lignin and polyphenolic extractives present in the pulps. Tin ions, especially derived from stannous compounds, are effective for brightening metal-discolored pulps. The improvement is surprisingly remarkable for sulphonated pulps contaminated with ferric ion. Stannous ion can be applied to cooked chips alone or in combination with bisulphite for brightness improvement in a mechanical refining stage. Stannous compounds can also be introduced prior to or following hydrosulphite or alkaline-hydrogen peroxide bleaching to improve bleaching efficiencies. Jack pine UHY pulps show little or no yellow discoloration with alum if the pulp is pretreated with a stannous compound. Stannous compounds can be used to replace papermakers' alum for fines retention and stock drainage improvement.

It will be understood that modifications can be made in the embodiment of the invention illustrated and described herein without departing from the scope and purview of the invention as defined by the appended claims.

What we claim as new and desire to protect by Letters Patent of the United States is:

1. A method of brightening an ultra high yield wood pulp containing discoloring metal ions present from at least one of the group consisting of ferrous, ferric, cupric, aluminum, nickel and manganese ions which comprises adding to said pulp a composition consisting of at least 0.001% Sn ions derived from the group consisting of stannous chloride, stannous sulphate, stannous tartrate, stannous oxalate, stannic chloride and stannic sulphate, on a pulp dry weight basis.

2. A method as claimed in claim 1 in which said wood pulp is a sulphonated pulp.

3. A method as claimed in claim 1 in which said Sn ions are added in an amount of 0.01 to 2.0% on a pulp dry weight basis.

4. A method as claimed in claim 1 in which said Sn ions are added in an amount of 0.01 to 0.05% on a pulp dry weight basis.

5. A method as claimed in claim 1 in which said Sn ions are added in an amount to provide a ratio of stannous ions to discoloring ions up to about 2:1.

6. A method as claimed in claim 4 in which said Sn ions are added in an amount to provide a ratio of stannous ions to discoloring ions of about 1.5:1.

7. A method as claimed in claim 1 in which said discoloring ions are ferric ions.

8. A method as claimed in claim 2 in which said wood is a sulphonated pulp from jack pine or spruce and said Sn ions are added in an amount of about 0.01 to 2.0% on a pulp dry weight basis.

9. A method as claimed in claim 1 in which said wood pulp is jack pine ultra high yield pulp containing at least one ferric, ferrous or cupric discoloring ions and said Sn compound is stannous chloride added in an amount to provide a ratio of stannous ions to discoloring ions up to about 2:1.

10. A method as claimed in claim 1 in whicn said wood pulp has been formed from wood chips subjected to sulphite chemical treatment.

11. A method as claimed in claim 1 in which said composition is added after said wood pulp has been bleached by hydrogen peroxide.

12. A method as claimed in claim 1 including the step of treating the wood pulp with aluminum sulphate and adding at least 0.01% of the Sn ions prior to the addition of aluminum sulphate.

13. A method as claimed in claim 1 in which the wood pulp is a sulphonated spruce pulp.

* * * * *

UNITED STATES PATENT AND TRADEMARK OFFICE

CERTIFICATE OF CORRECTION

PATENT NO. : 4,549,929

DATED : October 29, 1985

INVENTOR(S) : Ching-Hua TAY and Raymond S. FAIRCHILD

It is certified that error appears in the above-identified patent and that said Letters Patent are hereby corrected as shown below:

On the title page;

The title of the invention is "Tin Compounds for Brightness Improvement of Jack Pine Ultra High Yield Pulp" and not "Tin Compounds for Brightness Improvement of Jack Pine Ultra".

Signed and Sealed this

*Twenty-second* Day of *April 1986*

[SEAL]

*Attest:*

DONALD J. QUIGG

*Attesting Officer*

*Commissioner of Patents and Trademarks*